US005131052A

United States Patent [19]

Hill et al.

[11] Patent Number: 5,131,052

[45] Date of Patent: Jul. 14, 1992

[54] MID-RANGE LOUDSPEAKER ASSEMBLY PROPAGATING FORWARD AND BACKWARD SOUND WAVES IN PHASE

[76] Inventors: Amel L. Hill, 2837 Summerbrooke Way, Casselberry, Fla. 32707; John F. Goad, 2933 E. Floral Way, Apoqka, Fla. 37703; Barry Goldfarb, c/o C.W.P. Enterprises, Inc., 1108 W. Euclid Ave., DeLand, Fla. 32723

[21] Appl. No.: 294,364

[22] Filed: Jan. 6, 1989

[51] Int. Cl.[5] ..... H04R 25/00; G10K 11/00; A47B 81/06

[52] U.S. Cl. ..... 381/159; 381/90; 381/150; 381/153; 381/158; 181/175; 181/198; 181/199

[58] Field of Search ..... 381/158, 87–90, 381/97, 153, 155, 159, 160, 161, 70, 111, 158, 163, 200, 150, 192; 181/155, 156, 154, 199, 198, 175

[56] References Cited

U.S. PATENT DOCUMENTS

| | | | |
|---|---|---|---|
| 3,393,766 | 7/1968 | Mitchell | 381/88 |
| 3,688,864 | 9/1972 | Guss | 381/158 |
| 3,816,672 | 6/1974 | Gefvert | 381/158 |
| 4,144,416 | 3/1979 | Babb | 381/158 |
| 4,224,469 | 9/1980 | Karson | 381/158 |
| 4,611,686 | 9/1986 | Kobayashi et al. | 181/199 |
| 4,620,317 | 10/1986 | Anderson | 381/90 |
| 4,753,317 | 6/1988 | Flanders | 181/199 |
| 4,819,761 | 4/1989 | Dick | 381/158 |
| 4,875,546 | 10/1989 | Krnan | 381/90 |

FOREIGN PATENT DOCUMENTS

| | | | |
|---|---|---|---|
| 63-313999 | 12/1988 | Japan | 381/153 |
| 63-314098 | 12/1988 | Japan | 381/153 |

*Primary Examiner*—James L. Dwyer
*Assistant Examiner*—William D. Cumming
*Attorney, Agent, or Firm*—Banner, Birch, McKie & Beckett

[57] ABSTRACT

A loudspeaker assembly includes a vibrating element which generates pressure waves in a first predetermined frequency range which propagate in a first forward direction and a second backward direction. A driver drives the vibrating element. A first diffuser uniformly diffuses the forward waves. A tuner selects back waves in a second predetermined frequency range within said first predetermined frequency range. The tuner includes a second diffuser for diffusing the back waves within said second frequency range such that the selected back waves and the front waves are in phase.

15 Claims, 4 Drawing Sheets

MID-RANGE LOUDSPEAKER ASSEMBLY PROPAGATING FORWARD AND BACKWARD SOUND WAVES IN PHASE

This application is related by subject matter to commonly assigned, copending application Ser. Nos. 07/294,365, 07/294,366, now U.S. Pat. No. 5,027,411, and 07/294,446 now abandoned, filed concurrently herewith.

BACKGROUND OF THE INVENTION

The present invention is generally related to an improved loudspeaker assembly for frequencies in a range of approximately 150 Hz to 6 kHz.

The basic theory of sound transmission is set forth, for example, in standard introductory physics textbooks such as Resnick and Halliday, *Physics, Part I*, John Wiley & Sons, 1977, pp. 433–456. As described therein, audible sound is a longitudinal mechanical wave having a frequency within a range of approximately 20 Hz to 20 kHz. Typically, sound is generated by vibrating elements which alternately compress the surrounding air on a forward movement and rarefy it on a backward movement. Air transmits these disturbances outward from the source as a longitudinal wave. Upon entering the ear, these waves produce the sensation of sound.

A loudspeaker is generally understood to be a device which converts electrical energy into sound energy. Different loudspeakers are utilized to reproduce various parts of the audible frequency range. A woofer is generally responsive only to the lower acoustic frequencies and reproduces sounds of low pitch. A tweeter, in contrast, is a relatively small loudspeaker responsive only to the higher acoustic frequencies and reproduces sounds of high pitch. A so-called mid-range speaker reproduces sounds having frequencies intermediate of the woofer and tweeter.

The primary components of a loudspeaker are an electromagnet and a vibrating diaphragm attached to an armature that is vibrated by the variations of electric current in the electromagnet. A cone speaker is a particular type of loudspeaker in which the vibrating diaphragm is relatively large and conical and usually made of paper. A simple cone speaker assembly 3 is shown in FIG. 1 and includes a speaker housing or cabinet 5, transducer 6, and speaker cone 7. Transducer 6 causes speaker cone 7 to vibrate in response to signals from an amplifier (not shown), thus producing sound in the manner described above. The vibration of speaker cone 7 generates two longitudinal sound waves which, at least initially, propagate in opposite directions. Front waves 8 propagate to the right in FIG. 1 while back waves 9 propagate to the left. It is generally this front wave which generates the sounds, such as music, heard by a listener. The sounds heard by a listener are often directional in nature, i.e., they are dependent on the relative positioning of the loudspeaker and the listener. Thus, the loudspeakers in a room must be carefully arranged by a listener to attempt to properly direct the sound for maximum acoustic quality. However, even careful arrangement of speakers within a room is often unsatisfactory since it is unlikely that all listeners in a given room will be positioned so as to be in a region of maximum acoustic quality.

It will be appreciated that as speaker cone 7 is moved to the right, a compression is generated in the front wave while a rarefaction is generated in the back wave.

Similarly, when speaker cone 7 is moved to the left, a rarefaction is generated in the front wave and a compression is generated in the back wave. Thus, the front wave and back wave are 180° out of phase. If the back waves are permitted to emanate from speaker housing 6 at the same time as or "coincident" with the front waves, the waves will tend to destructively interfere or cancel since they are out of phase. This results in low quality sound reproduction by the loudspeaker. However, the elimination or non-use of this back wave in conventional speakers is inherently inefficient, i.e., half of the sound reproducing capabilities of the speaker are not utilized.

The vibration of speaker cone 7 generates subordinate vibrations such as cabinet vibrations. This is particularly true of cabinets formed of acoustically active materials such as wood which are relatively sensitive to vibratory forces. These subordinate vibrations modify or "cloud" the sound generated by the excitation of speaker cone 7. This effect is known as intermodulation (IM) distortion. The intermodulation produces resultant waves with frequencies that are equal to the sums and differences of integral multiples of the cone vibration frequency and the cabinet vibration frequency. Other subordinate vibrations also contribute to the IM distortion. IM distortion is an important factor which must be addressed in speaker design. Conventional speakers have IM distortion of 10–20%.

Since loudspeakers are designed to reproduce sound as faithfully as possible, the design must be compatible with the physics of sound, particularly if it is desired to reproduce high fidelity musical sound. Musical waveforms have a sinusoidal basis. Since sine waves are algebraic, a sound reproduction device should be curvilinear, rather than rectilinear, in design. An example of such design is the "bell-type" shape of many musical instruments.

All musical sound waves travelling in a medium (such as air, water, etc.) are acoustical (or physical). The sound waves are also algebraic functions since the fundamental frequency is sinusoidal (as on the lowest notes from a flute). All harmonics, or overtones, are also sinusoidal. Since the function of a loudspeaker is to receive the electronic format of the sound and reproduce the sound as acoustical (or physical) wave action in the medium through which it travels, it follows that the shapes involved in the loudspeaker baffle, resonating and transferral devices should be compatible with this sinusoidal nature. Therefore, the most compatible shapes should be curves, spheres, triangles or pyramids, rather than straight lines, cubes, squares or rectangles. The compatible sinusoidal shapes greatly enhance the sinusoidal characteristics of each fundamental frequency and its complement of harmonics, or overtones. This also applies to "ports" which transfer acoustical sound pressure waves within the speaker assembly, and also to the transfer of the waves to the surrounding transmitting medium.

The present invention is concerned with an improved mid-range speaker which reproduces sounds having a frequency between approximately 150 Hz and 6 kHz.

SUMMARY OF THE INVENTION

Accordingly, it is an object of the present invention to provide a loudspeaker which reduces intermodulation distortion.

It is another object of the present invention to provide a loudspeaker in which the acoustic quality is independent of a listener's location relative to the loudspeaker.

It is another object of the present invention to provide a more efficient loudspeaker which utilizes both the front and the back waves to reproduce sound.

It is another object of the present invention to provide a loudspeaker of high acoustic quality which has a small physical size.

It is another object of the present invention to provide a loudspeaker including a housing or cabinet which is acoustically inert.

It is yet another object of the present invention to provide a loudspeaker which is simple to manufacture.

It is yet another object of the present invention to provide a loudspeaker which is inexpensive to manufacture.

In accordance with the present invention, a loudspeaker assembly includes a vibrating element which generates pressure waves in a first predetermined frequency range which propagate is a first forward direction and in a second backward direction. A driver drives the vibrating element. A first diffuser uniformly diffuses the forward waves. A tuner selects back waves in a second predetermined frequency range within the first predetermined frequency range. The tuner includes a second diffuser for diffusing the back waves within the second frequency range such that the selected back waves and the front waves are in phase.

BRIEF DESCRIPTION OF THE DRAWINGS

A more complete understanding of the present invention and many of the attendant advantages thereof will be readily obtained as the specification is read in light of the accompanying drawings wherein.

DETAILED DESCRIPTION

Figure 1:
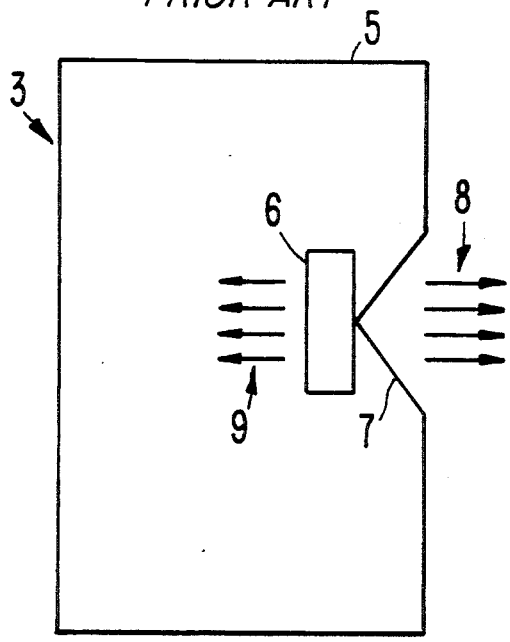
FIG. 1. PRIOR ART
FIG. 1 is a cross-sectional view of a conventional cone speaker.
Figure 2:
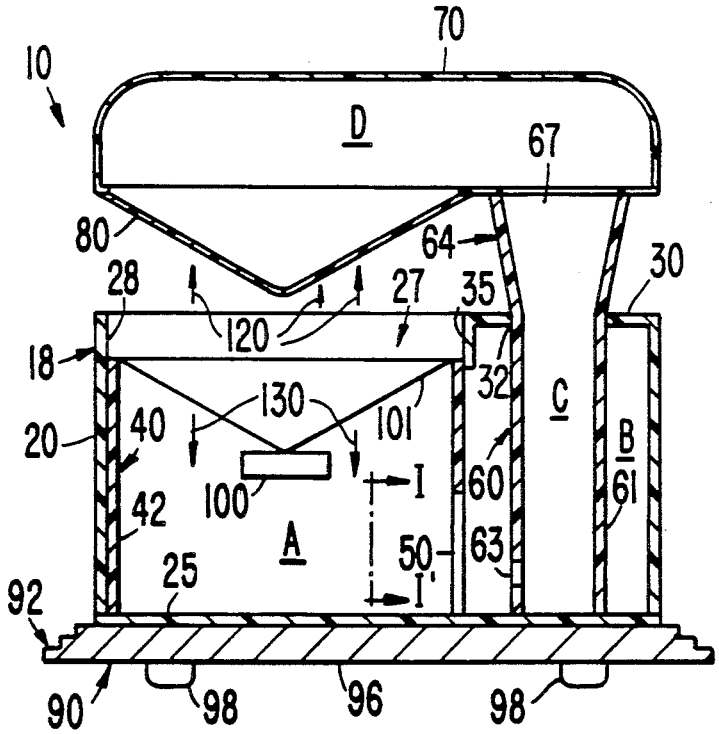
FIG. 2 is a cross-sectional view of a loudspeaker in accordance with an embodiment of the present invention.

FIG. 2 is a cross-sectional view of a loudspeaker assembly in accordance with an embodiment of the present invention. The loudspeaker of this embodiment, generally referred to as mid-range speaker, is intended to operate over a frequency range of approximately 150 kHz to 6 kHz. It will be readily apparent to those of skill in the art that the teachings and principles of this invention may be utilized to construct loudspeakers which operate over a wider or narrower frequency range, and the invention should not be limited in this respect.

Figure 3:
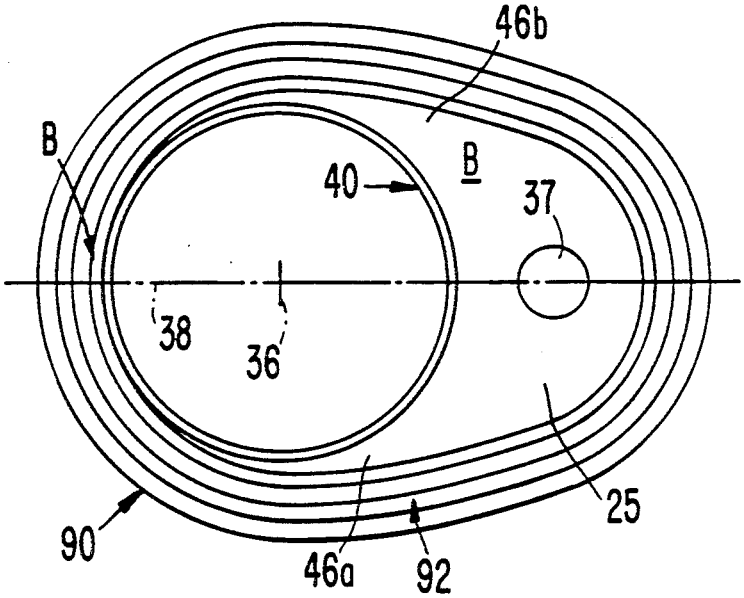
FIG. 3 is a plan view (without top) of the loudspeaker of FIG. 2.

Numeral 10 generally designates the loudspeaker assembly. Loudspeaker assembly 10 includes speaker housing or cabinet 18 having sidewall 20 and bottom wall 25 which together define an interior region 27. Sidewall 20 and bottom wall 25 are preferably molded as a single unit, although this is not critical. Speaker housing 18 further includes top wall 30. Top wall 30 may be bonded to sidewall 20 or molded therewith. Top wall 30 includes an inward projection or lip 35 which projects into interior region 27. Top wall 30 is configured so as to define a circular opening 28 in speaker housing 18. As shown in FIG. 3, vertical axis 36 of circular opening 28 intersects the major axis 38 of the ellipse-like shape defined by bottom wall 25 of speaker housing 18. Top wall 30 further includes a circular opening 32 formed therein so as to receive tube 60 as described in detail below. As shown in FIG. 3, circular opening 32 is positioned such that vertical axis 37 intersects the major axis 38 of the ellipse-like shape defined by bottom wall 25 of speaker housing 18.

An inner housing 40 is slidably received within speaker housing 18 through circular opening 28. Inner housing 40 supports and contains transducer 100 and speaker cone 101. Transducer 100 and speaker cone 101 define an acoustic chamber A having a first predetermined volume within inner housing 40. Sidewall 42 of inner housing 40 and inward projection 35 of top wall 30 define an acoustic chamber B having a second predetermined volume within interior region 27. Chamber A communicates with chamber B through triangular opening 50 formed in sidewall 42 of inner housing 40.

As best shown in FIG. 3, speaker housing 18 has an ellipse-like shape, perhaps better referred to as a "canned ham" shape. While the invention is not limited in this respect, this particular shape has certain favorable characteristics. Sound energy passing through opening 50 is funnelled toward opening 63 of tube 60 by the narrowing of sidewall 20. In addition the regions **46*a* and 46*b*** tend to damp out energy trapped in chamber B.

Figure 4:
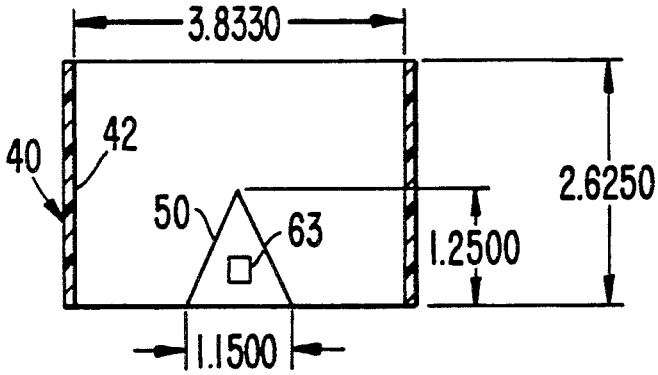
FIG. 4 is a cross-sectional view along line I—I' of FIG. 2.
Figure 5:
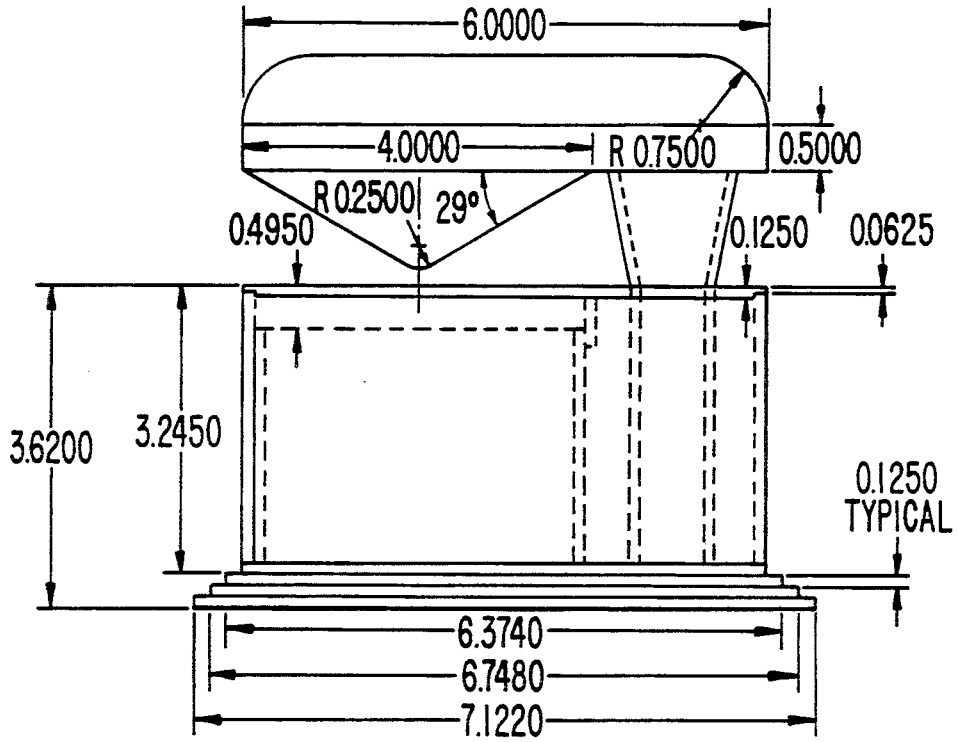
FIG. 5 is a side view similar to FIG. 2 illustrating the dimensions of the embodiment.
Figure 6:
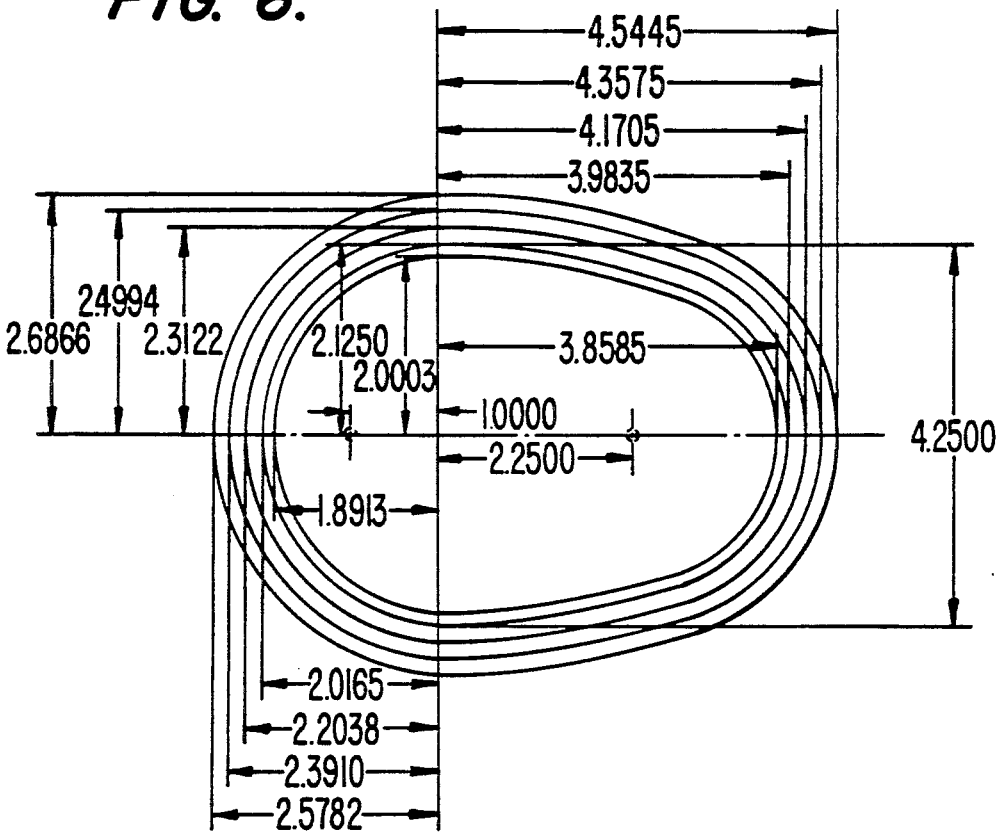
FIG. 6 is a plan view similar to FIG. 3 illustrating the dimensions of the embodiment.
Figure 7:
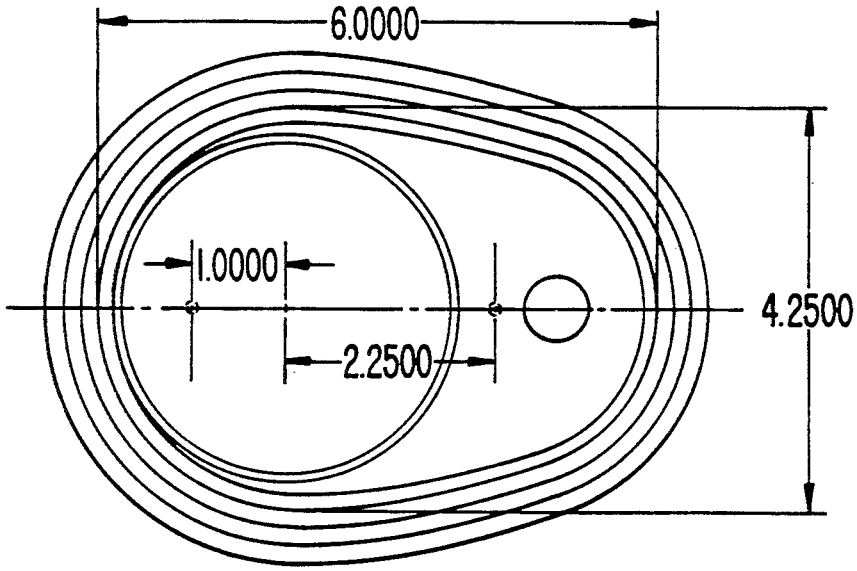
FIG. 7 is a plan view illustrating the base dimensions of the embodiment of FIG. 2.
Figure 8:
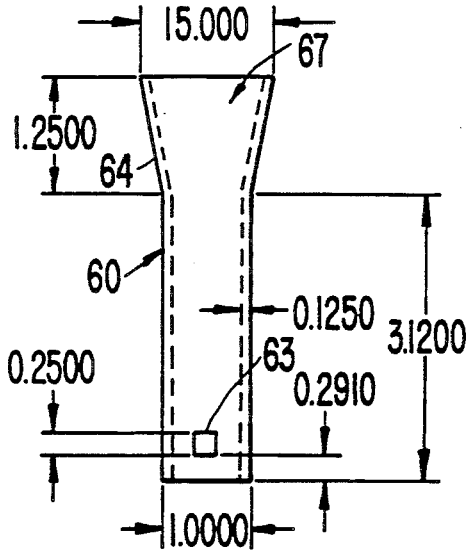
FIG. 8 is a side view illustrating the dimensions of the tube of the embodiment of FIG. 2.
Figure 9:
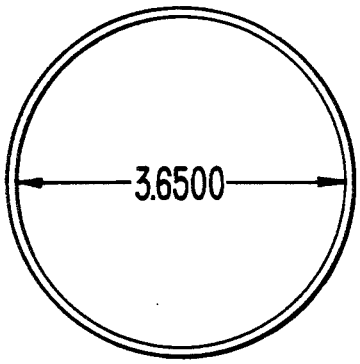
FIG. 9 is an overhead view illustrating the dimensions of the inner housing of the embodiment of FIG. 2.

Tube 60 is disposed in chamber B through circular opening 32. The bottom of tube 60 is preferably retained in a guide formed in bottom wall 25. This ensures a seal between chambers B and C and permits communication between the chambers only through rectangular opening 63. Other methods of forming the seal are known and available. The interior region of tube 60 is denoted as chamber C. Chamber C has a third predetermined volume. Chamber B communicates with chamber C through rectangular opening 63 formed in sidewall 61 of tube 60. Triangular opening 50 is axially aligned with rectangular opening 63 as shown in FIG. 4. Upper end 64 of tube 60 which projects through circular opening 32 has a linearly increasing diameter and forms a pressure nozzle 67. Tube 60 opens into chamber D of a fourth predetermined volume. Chamber D is defined by tympanic membrane 70 and diffuser cone 80.

Loudspeaker assembly 10 also includes base 90 secured to bottom wall 25 of speaker housing 18. Base 90 includes a flange portion generally indicated as 92 having a diameter greater than the diameter of speaker housing 18. A plurality of non-skid feet 98, formed from a high friction material such as rubber, are secured to the bottom surface 96 of base 90. Typically, three such feet are utilized although the invention is not limited in this respect.

Speaker housing 18, inner housing 40, flared tube 60 and diffuser cone 80 are preferably formed of ABS® foam plastic. ABS® is a registered trademark of the DuPont Corporation. ABS® foam plastic is a sonically dead, dense material that is acoustically inert. Other materials such as acrylics may also be used. While the present invention contemplates that the above-mentioned speaker components may be formed from a wide range of materials, acoustically inert materials have been found to enhance acoustic quality.

Base 90 may be formed from materials which are not acoustically inert without significantly affecting acoustic quality. Base 90 should, however, function to prevent the loudspeaker from being pushed up against a wall or if, for example, the loudspeaker is positioned on a bookshelf, a book or other object. The loudspeaker of the present invention will perform as described in detail below, even when enclosed on three sides. However, objects in contact with the speaker will adversely affect the speaker's performance. Although the illustrated base contains a plurality of flanges, the particular features may be ornamental and are not critical so long as contact with walls and other objects is effectively prevented.

In the preferred embodiment, transducer 100 is coupled to an amplifier which provides signals in a frequency range of 150 Hz to 6 kHz at the same power as signals delivered to other speakers as described in U.S. application Ser. No. 07/294,446 now abandoned. It will be apparent that other amplifiers may be utilized. In response to the amplifier output, acoustic pressure or sound waves are generated. These waves include front waves, generally indicated as 120 and back waves, generally indicated as 130. The front waves are uniformly diffused by diffuser cone 80. Thus, the front wave B is uniformly diffused throughout the area within which the loudspeaker assembly is contained.

As described above, the loudspeaker assembly of the present invention includes four chambers A, B, C and D. Back waves generated by the speaker cone successively pass through chambers A, B, C, and D, the volumes of the chambers arranged such that volume A>volume B>volume C. The chambers are frequency tuned by means of the openings formed in chambers A, B, and C. The principle involved is similar to that utilized in obtaining a particular frequency in an organ pipe.

Back waves generated by the vibration of speaker cone 101 pass from chamber A to chamber B through triangular opening 50. This triangular port acts as a tuning port for the first chamber as discussed in greater detail in the Appendix. Sound waves pass through triangular opening 50. Although the calculations are somewhat more complicated, the principles set forth in the Appendix demonstrate that the predetermined volume and the size triangular opening of chamber A may be used to absorb or damp energy at particular frequencies. Thus, chamber A behaves like a first bandpass filter which permits or selects only a predetermined band of frequencies (again based on the volume of chamber A and the size of the triangular opening) to pass to chamber B. In a preferred embodiment, the frequency band is approximately 1.3 kHz to 5.5 kHz. Chamber B is pressurized by the sound waves and creates acoustic resistance to the motion of the speaker diaphragm.

It is now desirable to filter or tune the same band of frequencies from chamber B to chamber C. Again, although the equations become more complicated, the principles set forth in the Appendix are applicable. By having a predetermined volume for chamber B and providing a rectangular tuning port of a predetermined size, a second bandpass filter is created which passes the same band of frequencies from chamber B to chamber C as from chamber A to chamber B.

Tube 60 has a predetermined length and diameter so as to define a predetermined volume C. Once again, reference should be made to the Appendix to demonstrate that such an arrangement may be utilized to form a third bandpass filter for the selected frequencies. Tube 60 acts as a waveguide for the sound waves which are admitted thereto. The sound waves in tube 60 are forced upward and out a flared opening. Venturi opening 67 and the volume of chamber D form a fourth bandpass filter for the selected frequencies. The waves enter chamber D under considerable pressure. In short, the size of the ports and the chamber dimensions are chosen to produce the highest efficiency of a fourth order tuned frequency. That is to say, not all frequencies will result in efficient speaker operation. For example, lower mid-range frequencies would not arrive at the diffuser cone coincident with the front wave and would tend to generate IM distortion. The selected frequencies and thus port size and chamber volume must be chosen keeping this and similar considerations in mind.

Chamber D is constructed such that the top structural layer is a thin, plastic, highly reactive, tympanic membrane. Tympanic membrane 70 is responsive to the high pressure sound waves introduced into chamber D. Thus, tympanic membrane 70 vibrates and generates sound waves external to the speaker. It is preferable that tympanic membrane 70 be of uniform thickness. This may be achieved by injection molding for example. The tympanic membrane is of a shape and character that it retains its size and shape during the vibrational motion. This is due in part to the attachment of the membrane about its circumference to diffuser cone 80. The tympanic membrane plays an important role in the invention. The diffuser cone ensures a good, uniform horizontal dispersion and adequate vertical dispersion of the sound. However, the diffuser cone inhibits vertical dispersion directly over the cone. However, the vibration of the tympanic membrane generates vertical dispersion of sound and achieves superior acoustic qualities and omnidirectional characteristics for the loudspeaker.

Thus, the tuning of the sound waves as they pass through the various chambers and openings permits an omnidirectional response from not only the front sound waves, but also the back sound waves tuned by the chambers and openings. As noted above, the tuned frequency range is approximately 1.3 kHz to 5.5 kHz from the 150 Hz to 6 kHz band.

The openings between the chambers serve as filters which tune out the lower frequencies of the mid-range. The size of the openings and the volumes of the chambers determine the frequencies which are filtered. The portion of the backwave entering the flared tube reaches the diffusion cone coincident with the arrival of the front wave. The tympanic membrane permits almost complete vertical and horizontal dispersion. The openings are dimensioned to filter certain frequencies. For example, low mid-range frequencies must be filtered since they would generate too much air pressure in the flared tube and potentially damage the tympanic membrane and affect the seal between the tympanic membrane and the flared tube. The size and positioning of the openings or "tuning ports" may be calculated and may be determined by those of ordinary skill. Thus, although the dimensions of the tuning ports for the illustrated embodiment are important, the dimensions may be adapted to filter or tune different frequencies or adapted for use in different size speakers.

It is clear that the volume of the various chambers and size of the various tuning ports are important to the successful implementation of the present invention. FIGS. 5–10 provide the various dimensions utilized in the above-described embodiment. It is emphasized that while the various dimensions are important, the invention is not limited in this respect. It will be apparent to those of ordinary skill that other arrangements utilizing different dimensions are capable of being manufactured.

The loudspeaker of the present invention tunes and filters the back wave generated by the vibration of speaker cone 101 so as to be coincident with the front wave at diffuser cone 80. The tuned back wave is passed through the opening or pressure nozzle 67 into chamber D. When chamber D is pressure-loaded by the tuned back wave, tympanic membrane 70 at the top of loudspeaker 10 is excited. The tuned energy is used to excite tympanic membrane 70 and generates sound waves coincident with the sound waves reflected from diffuser cone 80. This effect produces an acoustic amplifier and reduces the amplifier voltage needed to generate mid-range frequencies. Tympanic membrane 70 generates sound which supplements the front wave sound of the loudspeaker. Tympanic membrane 70 essentially acts as a second loudspeaker.

The present invention is unique for the utilization of the back wave. This results in a dramatically more efficient loudspeaker than that of the prior art. Sound is emitted with both the frontward and backward movement of the speaker cone. The prior art does not utilize this back wave. In contrast, the present invention utilizes the entire cone excursion of the driver for sonic benefit. The present invention utilizes more of the sound emitting characteristics of the driver. A 60–70% gain in the efficiency of the usable cone area for a 4" speaker for a given frequency has been observed because the area of the tympanic membrane is larger.

The labyrinth of passages through which the sound waves move is an acoustically created Butterworth filter. The filter emphasizes the larger order ring nodes that the speaker cone is producing. This energy is shaped through the various ports. In this way, the smaller order ring nodes of the driver are not used for the back wave. Only certain frequencies are selected to propagate up tube 60 and excite the tympanic membrane. It is for these selected frequencies that the efficiency is increased.

Another advantage of the present invention is that due to the omnidirectional nature of the speakers, the only criteria in mid-range speaker placement is that one be on the right and one be on the left of the listener. The speakers may be positioned at different heights, angles, etc. without affecting acoustic quality.

Still another advantage of the present invention is size. The loudspeakers of the present invention are small and compact and may even be utilized on bookshelves and the like. However, acoustic quality is not compromised. Another advantage is the omnidirectional nature of the sound. Further, every motion of the sonic cone is utilized.

Another advantage of the present invention is that the material utilized in the construction of the speaker is not as critical as in the prior art. Thus, high quality sound may be generated for less cost utilizing relatively inexpensive material. The speakers are relatively easy to produce once an initial mold has been made. The ABS® foam plastic currently utilized is produced by GE Plastics of Parkersburg, West Virginia. ABS® foam has superior acoustic characteristics and exhibits no resonance.

Use of the back wave as taught by the present invention significantly minimizes intermodulation distortion. Since the front wave and the tuned back waves strike the opposite sides of the diffuser cone coincident in time, vibration of the diffuser cone is dramatically reduced. This in turn dramatically reduces the IM distortion due to diffusion cone vibration. In addition, IM distortion is reduced by the use of an acoustically inert material such as ABS® foam plastic to form the speaker components. Typically, IM distortion is 10–20%. With the present invention, the IM distortion is less than 1%, representing a 10–20 fold improvement over the prior art. These results are also due to the tuned frequencies of the back wave which are in a range of approximately 1.3 kHz–5.5 kHz. More specifically, the upper frequency limit is approximately 5 kHz–5.5 kHz and the low end is 1.3–1.8 kHz. Thus, the reduction in IM distortion is highly dependent on the size of the tuning ports and the Venturi opening.

Another advantage is that the current design may apparently be scaled up 50%–70% from the illustrated 3½" embodiment to approximately an 8½ inch speaker. Use of a 4" speaker has been found to provide especially favorable acoustic qualities. The width of opening 63 has been changed to 0.50" in the 4" embodiment. However, it has been determined that the size and dimensions of triangular opening 50 should remain the same while the remainder of the dimensions apparently may be appropriately scaled.

Finally, the present invention is weatherproof.

As noted above, a 4" speaker provides favorable acoustic quality. A preferred 4" speaker an Audax speaker. In general, the 4" speaker characteristics of the present invention are reproduced in Table I.

| 4" Full Range Driver | Symbol | Value | Unit |
|---|---|---|---|
| Average sensitivity level (1 W, 1 m) | | 86 | dB |
| Nominal impedance | Z | 8 | Ohm |
| DC resistance | Pe | 6.8 | Ohm |
| Resonant frequency | fs | 64 | Hz |
| Equivalent volume of compliance | Vas | — | m 3 |
| Mechanical Q factor | Qms | 4.67 | |
| Electrical Q factor | Qes | 0.82 | |
| Total Q factor | Qts | 0.70 | |
| Effective cone radius | rd | 0.049 | m |
| Voice coil diameter | d | 25.6 | mm |
| Voice coil former material | | Aluminum | |

It should be noted that the speaker and speaker configuration illustrated are the current embodiments. However, it will be apparent to those of skill in the art that it is possible to configure the speaker cone so as to maximize the efficiency with which the backwave is forced through the openings and such variations are contemplated by the invention.

The invention has been described in detail in connection with the preferred embodiments. These embodiments, however, are merely for example only and the invention is not restricted thereto. It will be easily understood by those skilled in the art that other variations and modifications can easily be made within the scope of this invention as defined by the appended claims.

APPENDIX

The archtypical Helmholtz resonator is an acoustic device that consists of a rigid enclosure with a volume V coupled to the atmosphere through an open pipe with radius r and length l, as indicated in Example 17-2 in Marion & Hornyak, *Principles of Physics*, Saunders College Publishing, 1984. As illustrated therein, a hypothetical displacement of the air mass in the pipe intruding a distance x into the main volume of the resonator. The intrusion compresses the air in the resonator by an amount $\Delta V = \pi r^2 x$. This produces a pressure on the intruding mass given by $$p = -Ba\frac{\Delta V}{V} = -Ba\frac{\pi r^2 x}{V} = \frac{-v^2 po\pi r^2}{V}x$$

The restoring force is $$\delta F = \pi r^2 \delta_p = \frac{-v^2\rho \cdot \pi^2 r^4}{V}X = -Kx$$

where the force constant X for the volume of gas is $$K = \frac{V^2\rho \cdot \pi^2 r^4}{V}$$

The mass of the air oscillating in the pipe is $m = \pi r^2 l\rho$. The natural frequency is therefore $$Vo = \frac{1}{2\pi}\sqrt{\frac{K}{m}} = \frac{v}{2\pi}\sqrt{\frac{\pi r^2}{Vl}}$$

When the system is excited, there is actually a small mass of air just beyond the open pipe which is also set in motion. Taking this into account increases the effective length of the pipe. It can be shown that $$Vo = \frac{v}{2\pi}\sqrt{\frac{\pi r^2}{V(1 + 8r/3\pi)}}$$

Thus, even if $l = o$, there is an effective mass, $8r^3\rho_o/3$, associated with the vent opening.

If, for example, the volume V is a speaker enclosure which is a Helmholtz resonator with the same natural frequency Vo, the energy absorbed from the oscillating speaker cone by the air in the enclosure is a maximum, which results in optimal damping.

We claim:

1. A loudspeaker assembly comprising:
   - an outer housing having a bottom wall, a side wall, and a top wall, said top wall having an opening formed therethrough and being configured to define an opening in said outer housing;
   - an inner housing disposed within said outer housing;
   - a flared tube extending through the opening in the top wall of said outer housing;
   - a speaker cone disposed within said inner housing;
   - driving means for driving said speaker cone so as to generate in a first frequency range forward sound waves which propagate in the medium in a forward direction and back sound waves which propagate in the medium in a backward direction;
   - first sound dispersing means for dispersing the forward sound waves; and
   - second sound dispersing means for dispersing the back sound waves; and
   - respective openings formed in said inner housing and said flared tube such that the back sound waves propagate therethrough to said sound dispersing means, said respective openings, said inner housing and said flared tube configured such that the back sound waves are tuned to a second frequency range within said first frequency range and the sound waves dispersed by the first sound dispersing means and the sound waves dispersed by the second sound dispersing means are in phase.

2. The loudspeaker assembly according to claim 1 wherein said outer housing comprises a plastic outer housing.

3. The loudspeaker assembly according to claim 1 wherein said inner housing comprises a plastic inner housing.

4. The loudspeaker assembly according to claim 1 wherein said venturi tube comprises a plastic venturi tube.

5. The loudspeaker assembly according to claim 1 wherein said first sound dispersing means comprises a diffuser cone which is axially aligned with said speaker cone.

6. The loudspeaker assembly according to claim 5 wherein said diffuser cone comprises a plastic diffuser cone.

7. The loudspeaker assembly according to claim 5 wherein said second sound dispersing means comprises a tympanic member, said tympanic member and said diffuser cone together defining a chamber into which back sound waves propagate from said venturi tube.

8. The loudspeaker assembly according to claim 7 wherein said tympanic member comprises a plastic tympanic member.

9. The loudspeaker assembly according to claim 7 wherein said speaker cone, an inner surface of said inner housing, and the bottom wall of said outer housing define a first chamber, an outer surface of said inner housing and the top and side walls of said outer housing define a second chamber coupled to said first chamber by the opening in said inner housing, said flared tube defines a third chamber coupled to said second chamber by the opening in said flared tube, and said diffuser cone and said tympanic member define a fourth chamber coupled to said third chamber by an open end of said flared tube, said first, second, third, and fourth chambers and said respective openings being configured to tune the sound waves propagated in the backward direction to a second frequency range within said first frequency range.

10. The loudspeaker assembly according to claim 1 wherein the first frequency range is approximately 150 Hz to approximately 6 kHz.

11. The loudspeaker assembly according to claim 1 wherein the second frequency range is approximately 1.3 kHz to approximately 5.5 kHz.

12. The loudspeaker assembly according to claim 1 wherein the first frequency range is approximately 150 Hz to approximately 6 kHz and the second frequency range is approximately 1.3 kHz to approximately 5.5 kHz.

13. The loudspeaker assembly according to claim 1 further comprising:
   - a base portion configured to prevent objects from contacting the outer housing.

14. The loudspeaker assembly according to claim 1 wherein said first sound dispersing means generates a uniform horizontal dispersion of the forward sound waves.

15. The loudspeaker assembly according to claim 1 wherein said second sound dispersing means generates a vertical dispersion of the back sound waves.

* * * * *